US010017236B1

(12) United States Patent
Navarte, III et al.

(10) Patent No.: US 10,017,236 B1
(45) Date of Patent: Jul. 10, 2018

(54) OUTBOARD MOTOR COWLING SPEAKER ASSEMBLY

(71) Applicants: Miguel Angel Navarte, III, Pompano Beach, FL (US); Miguel Angel Navarte, Jr., Miami, FL (US); Christopher Navarte, Miami, FL (US)

(72) Inventors: Miguel Angel Navarte, III, Pompano Beach, FL (US); Miguel Angel Navarte, Jr., Miami, FL (US); Christopher Navarte, Miami, FL (US)

( * ) Notice: Subject to any disclaimer, the term of this patent is extended or adjusted under 35 U.S.C. 154(b) by 12 days.

(21) Appl. No.: 15/461,951

(22) Filed: Mar. 17, 2017

(51) Int. Cl.
*B63H 20/32* (2006.01)
*H04R 1/02* (2006.01)

(52) U.S. Cl.
CPC ..... *B63H 20/32* (2013.01); *H04R 1/028* (2013.01); *H04R 2499/13* (2013.01)

(58) Field of Classification Search
None
See application file for complete search history.

(56) References Cited

U.S. PATENT DOCUMENTS 4,849,738 A * 7/1989 Forti ..... G08B 13/1454 340/568.1
9,193,429 B1 * 11/2015 Langenfeld ..... F01M 11/12

* cited by examiner

*Primary Examiner* — Curtis Kuntz
*Assistant Examiner* — Kenny Truong
(74) *Attorney, Agent, or Firm* — Albert Bordas, P.A.

(57) ABSTRACT

An outboard motor cowling speaker assembly having an outboard motor having at least one speaker assembly with a speaker. The at least one speaker assembly has a cover that covers and protects the speaker. The at least one speaker assembly mounts upon a speaker mount that has a leading edge and a lateral surface extending from the leading edge. The lateral surface extends from the leading edge and terminates at a trailing edge. The cover is fixed onto the trailing edge. The outboard motor has a cowling top face, first and second cowling lateral faces, a cowling front face, and a cowling rear face. The leading edge is closer to the cowling front face than the trailing edge. The at least one speaker assembly protrudes aerodynamically from the first and second cowling lateral faces. The outboard motor is mounted onto a sea vessel.

18 Claims, 4 Drawing Sheets

OUTBOARD MOTOR COWLING SPEAKER ASSEMBLY

BACKGROUND OF THE INVENTION

1. Field of the Invention

The present invention relates to outboard motor cowlings, and more particularly, to outboard motor cowling speaker assemblies.

2. Description of the Related Art

Applicant is not aware of any outboard motor cowlings having the novel features of the present invention.

SUMMARY OF THE INVENTION

The present invention is an outboard motor cowling speaker assembly, comprising an outboard motor having at least one speaker assembly. The at least one speaker assembly comprises a speaker. The at least one speaker assembly comprises a cover that covers and protects the speaker.

The at least one speaker assembly mounts upon a speaker mount. The speaker mount comprises a leading edge. The speaker mount comprises a lateral surface extending from the leading edge. The lateral surface extends at a predetermined angle from the leading edge. The lateral surface terminates at a trailing edge. The cover is fixed onto the trailing edge. The trailing edge is shaped to contour the speaker.

The outboard motor comprises a cowling top face, first and second cowling lateral faces, a cowling front face, and a cowling rear face. The leading edge is closer to the cowling front face than the trailing edge. The at least one speaker assembly protrudes aerodynamically from the first and second cowling lateral faces.

The outboard motor is mounted onto a sea vessel. The sea vessel is a boat, motorboat, yacht, or houseboat. The outboard motor comprises a lower unit and a propeller.

It is therefore one of the main objects of the present invention to provide an outboard motor cowling speaker assembly.

It is another object of this invention to provide an outboard motor cowling speaker assembly having a speaker assembly.

It is another object of this invention to provide an outboard motor cowling speaker assembly that is resistant to the environment.

It is another object of this invention to provide an outboard motor cowling speaker assembly that is durable and weather resistant.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
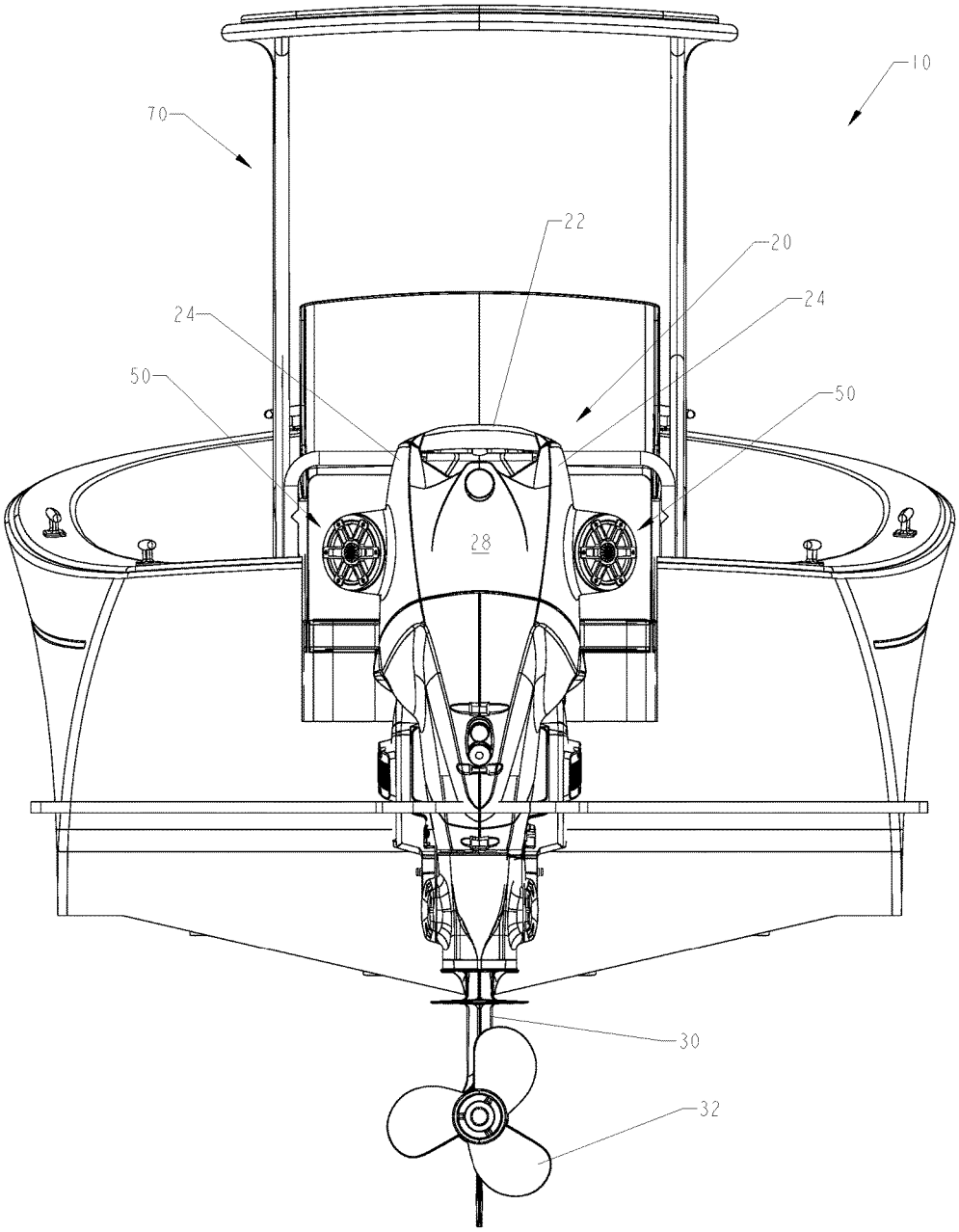
FIG. 1 is a rear view of the present invention mounted onto a sea vessel.

Referring now to the drawings, the present invention is an outboard motor cowling speaker assembly and is generally referred to with numeral 10. It can be observed that it basically includes outboard motor 20, speaker mount 40, and speaker assembly 50.

Figure 2:
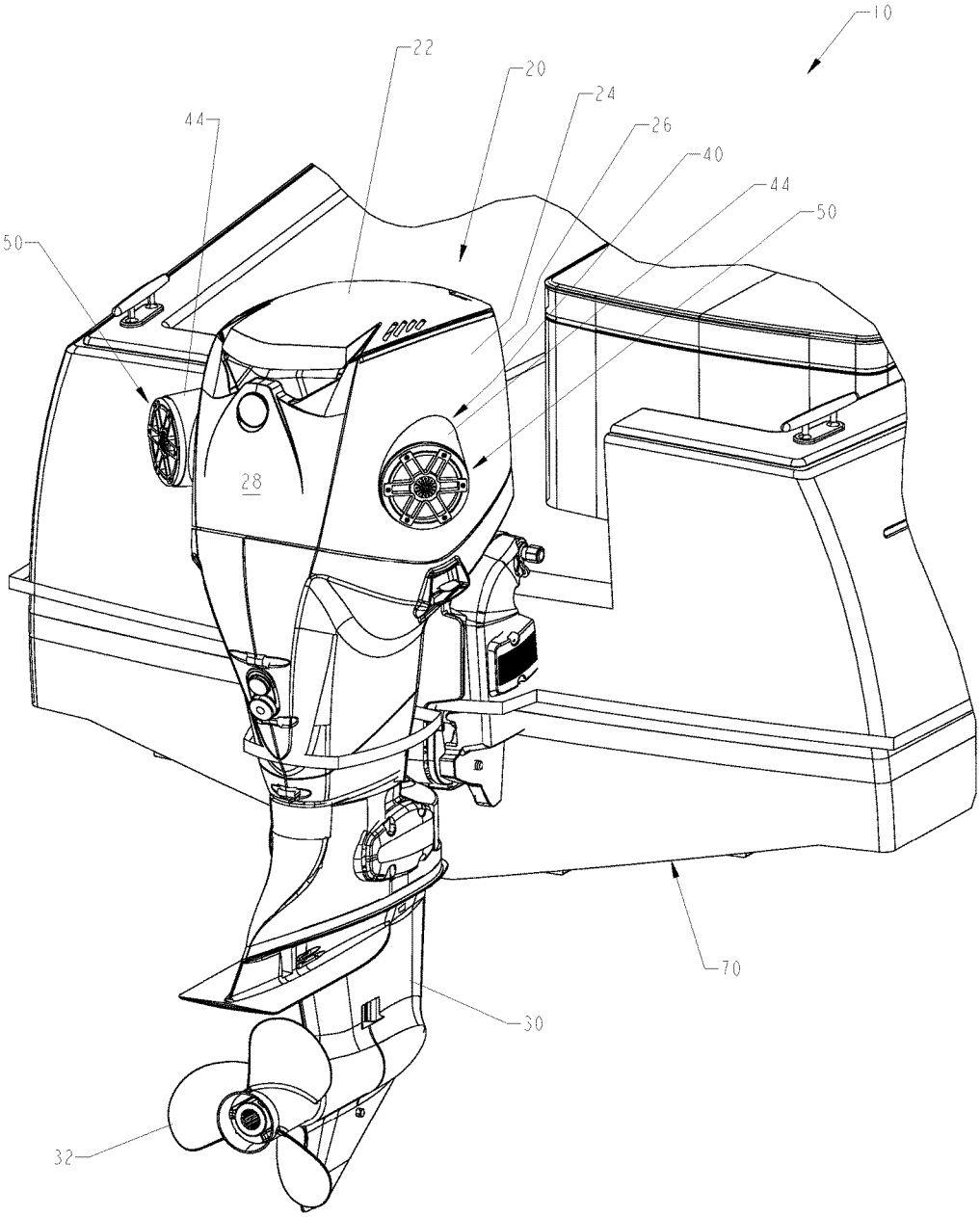
FIG. 2 is a first isometric view of the present invention mounted onto a sea vessel.
Figure 3:
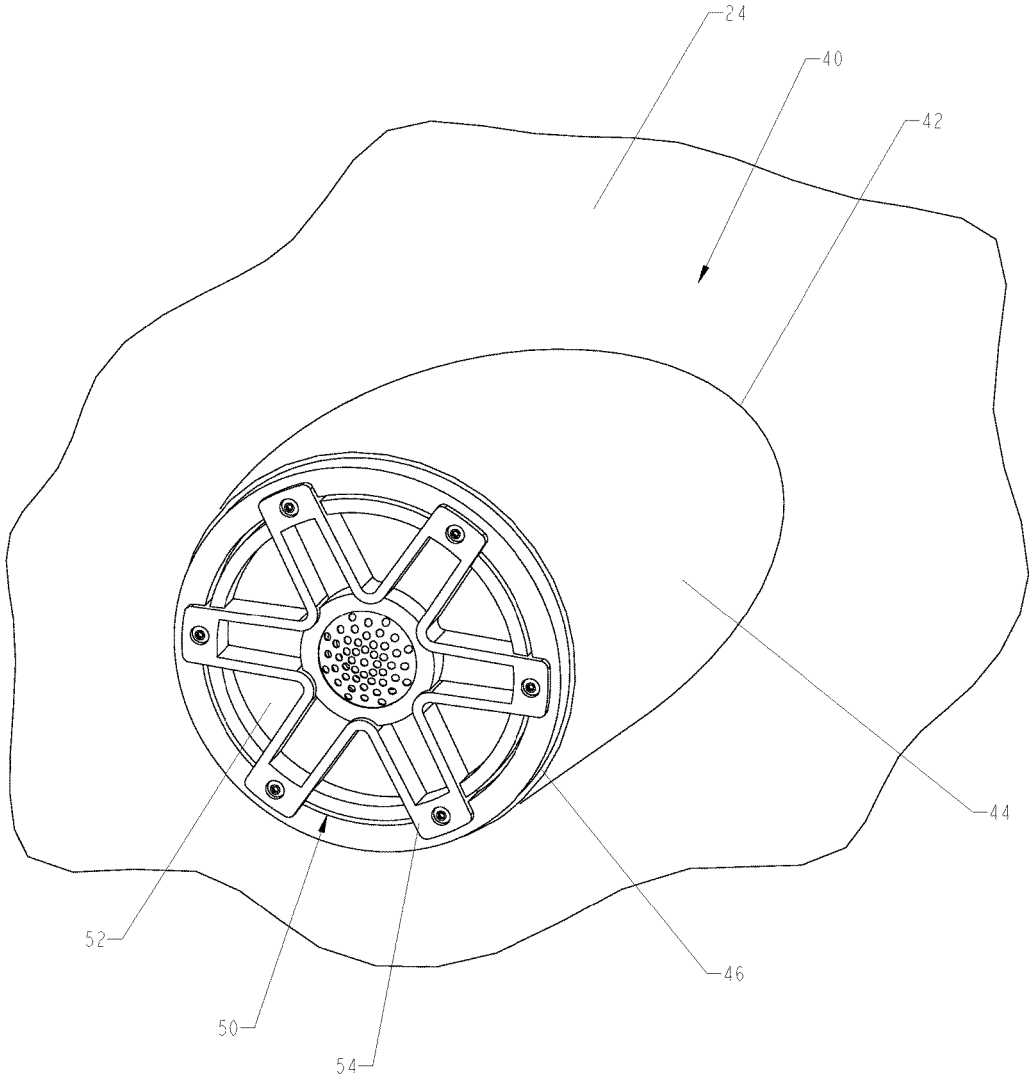
FIG. 3 is an isometric view of a speaker mount and speaker assembly of the present invention.
Figure 4:
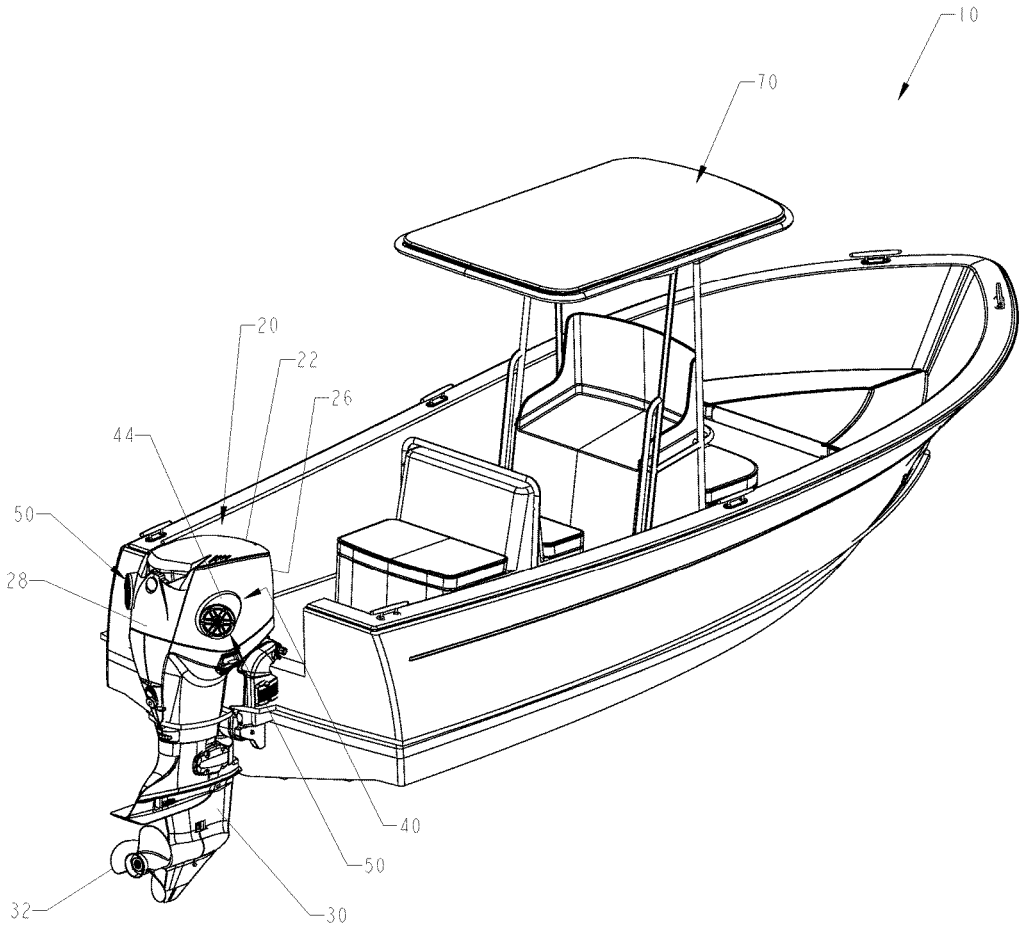
FIG. 4 is a second isometric view of the present invention mounted onto a sea vessel.

As seen in FIGS. 1 and 2, outboard motor cowling speaker assembly 10 comprises outboard motor 20 having at least one speaker assembly 50. Speaker assembly 50 comprises speaker 52. Speaker assembly 50 may also comprise cover 54 that covers and protects speaker 52. Speaker assembly 50 mounts upon speaker mount 40. Speaker mount 40 comprises leading edge 42. Speaker mount 40 comprises lateral surface 44 extending from leading edge 42. Lateral surface 44 extends at a predetermined angle from leading edge 42 and terminates at trailing edge 46. Cover 54 is fixed onto trailing edge 46. Trailing edge 46 is shaped to contour speaker 52.

Outboard motor 20 comprises cowling top face 22, first and second cowling lateral faces 24, cowling front face 26, and cowling rear face 28. Leading edge 42 is closer to cowling front face 26 than trailing edge 46. Speaker assembly 50 protrudes from first and second cowling lateral faces 24. In a preferred embodiment, speaker assembly 50 protrudes aerodynamically from first and second cowling lateral faces 24.

Outboard motor 20 is mounted onto sea vessel 70 that may be, but is not limited to being a boat, motorboat, yacht, or houseboat, whereby outboard motor 20 comprises lower unit 30 and propeller 32.

In a preferred embodiment, speaker assembly 50 is mounted symmetrically on said outboard motor 20.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An outboard motor cowling speaker assembly, comprising an outboard motor having at least one speaker assembly, said outboard motor comprises a cowling top face, first and second cowling lateral faces, a cowling front face, and a cowling rear face, said at least one speaker assembly protrudes from said first and second cowling lateral faces.

2. The outboard motor cowling speaker assembly set forth in claim 1, further characterized in that said at least one speaker assembly comprises a speaker.

3. The outboard motor cowling speaker assembly set forth in claim 2, further characterized in that said at least one speaker assembly comprises a cover.

4. The outboard motor cowling speaker assembly set forth in claim 3, further characterized in that said cover covers said speaker.

5. The outboard motor cowling speaker assembly set forth in claim 3, further characterized in that said at least one speaker assembly mounts upon a speaker mount.

6. The outboard motor cowling speaker assembly set forth in claim 3, further characterized in that said cover protects said speaker.

7. The outboard motor cowling speaker assembly set forth in claim 5, further characterized in that said speaker mount comprises a leading edge.

8. The outboard motor cowling speaker assembly set forth in claim 7, further characterized in that said speaker mount comprises a lateral surface extending from said leading edge.

9. The outboard motor cowling speaker assembly set forth in claim 8, further characterized in that said lateral surface extends at a predetermined angle from said leading edge.

10. The outboard motor cowling speaker assembly set forth in claim 9, further characterized in that said lateral surface terminates at a trailing edge.

11. The outboard motor cowling speaker assembly set forth in claim 10, further characterized in that said cover is fixed onto said trailing edge.

12. The outboard motor cowling speaker assembly set forth in claim 10, further characterized in that said leading edge is closer to said cowling front face than said trailing edge.

13. The outboard motor cowling speaker assembly set forth in claim 10, further characterized in that said trailing edge is shaped to contour said speaker.

14. The outboard motor cowling speaker assembly set forth in claim 1, further characterized in that said at least one speaker assembly protrudes aerodynamically from said first and second cowling lateral faces.

15. The outboard motor cowling speaker assembly set forth in claim 1, further characterized in that said outboard motor is mounted onto a sea vessel.

16. The outboard motor cowling speaker assembly set forth in claim 15, further characterized in that said sea vessel is a boat, motorboat, yacht, or houseboat.

17. The outboard motor cowling speaker assembly set forth in claim 1, further characterized in that said outboard motor comprises a lower unit.

18. The outboard motor cowling speaker assembly set forth in claim 1, further characterized in that said outboard motor comprises a propeller.

* * * * *